US005930984A

United States Patent [19]

Furuya et al.

[11] Patent Number: 5,930,984

[45] Date of Patent: Aug. 3, 1999

[54] METHOD FOR FORMING A BAND SEAL ON A CAPSULE

[75] Inventors: Yoshihiro Furuya, Osaka; Takao Enomoto, Neyagawa; Koji Sato, Kawanishi; Taiichi Mizuta, Takarazuka, all of Japan

[73] Assignee: Shionogi & Co., Ltd., Osaka, Japan

[21] Appl. No.: 08/919,222

[22] Filed: Aug. 28, 1997

[30] Foreign Application Priority Data

Aug. 29, 1996 [JP] Japan ..... 8-247305

[51] Int. Cl.[6] ..... B65B 7/28

[52] U.S. Cl. ..... 53/471; 53/383.1; 53/485; 53/900; 156/69; 156/308.4

[58] Field of Search ..... 55/454, 477, 471, 55/485, 560, 900, 383.1, 329, 329.2, 281; 156/69, 276, 308.4

[56] References Cited

U.S. PATENT DOCUMENTS

| | | | |
|---|---|---|---|
| 3,078,629 | 2/1963 | Bessemer et al. | 53/471 |
| 4,584,817 | 4/1986 | Yamamoto et al. | 53/900 |
| 4,734,149 | 3/1988 | Brown | 156/69 |
| 4,793,119 | 12/1988 | Maso | 53/139.3 |
| 4,991,377 | 2/1991 | Marchesini | 156/69 |

FOREIGN PATENT DOCUMENTS

| | | |
|---|---|---|
| 0152517A1 | 8/1985 | European Pat. Off. . |
| 0154966A2 | 9/1985 | European Pat. Off. . |
| 0271627A1 | 6/1988 | European Pat. Off. . |
| 0403214A1 | 12/1990 | European Pat. Off. . |

*Primary Examiner*—Lee W. Young
*Assistant Examiner*—Bobby Rushing, Jr.
*Attorney, Agent, or Firm*—Birch, Stewart, Kolasch & Birch, LLP

[57] ABSTRACT

A band seal is formed between a body and a cap of a capsule by fitting the cap on the body, and applying a gelatin-base sealant at least one time in the form of a band spanning the cap and the body. Band sealing is carried out by at least one of the following steps (A) to (E): the step (A) of applying the sealant at a temperature of 30–40° C. at least when the sealant is first applied, the step (B) of applying the sealant at a viscosity of 50–200 centipoises at 50° C. at least when the sealant is first applied, the step (C) of after the sealant is applied, blowing cold air at a temperature of up to 10° C. to the band seal to cool the band seal below 10° C., the step (D) of reducing the joint distance between the body and the cap shorter than the standard capsule length, and the step (E) of applying the sealant to only an edge adjacent portion of the cap surface when the sealant is first applied. The invention prevents bubbles from generating in the band seal.

13 Claims, 1 Drawing Sheet

METHOD FOR FORMING A BAND SEAL ON A CAPSULE

BACKGROUND OF THE INVENTION

1. Field of the Invention

This invention relates to a method for sealing a capsule by forming a band seal between a cap and a body of a capsule filled with drugs. More particularly, it relates to a method for forming a band seal between a cap and a body of a capsule in such a manner as to protect the band seal against defects such as bubbles and voids.

2. Prior Art

Capsules filled with various drugs are generally sealed in the prior art by fitting the cap on the body filled with drugs, and forming a circumferentially extending band seal axially spanning from the cap edge to the body surface to secure the cap to the body. The band sealing of capsules was originally employed for preventing mischief. Since it became a common practice to fill capsules with liquid drugs, the purpose of band sealing was diversified into, for example, purposes of preventing liquid leakage and preventing permeation of oxygen and water. It is thus desired to form a positive and accurate band seal on capsules.

In band sealing of capsules, however, bubbles and voids often occur in the band seal. Then, after band seals are formed, all the capsules must be inspected to pick up those capsules having defects in the band seal. Because the rejected capsules are discarded, a large number of defective band seals increases waste and is economically disadvantageous.

There is a need for a method for forming a band seal on a capsule while preventing bubbles and defects from occurring in the band seal.

SUMMARY OF THE INVENTION

Therefore, an object of the invention is to provide a method for forming a band seal on a capsule in such a manner as to prevent bubbles and perforations from occurring in the band seal.

The invention is directed to a method for forming a band seal between a body and a cap of a capsule, comprising the steps of fitting the cap on the body filled with drugs, and applying a gelatin-base sealant at least one time in the form of a circumferentially extending band axially spanning the cap surface and the body surface across the edge of the cap to form at least one layer of band seal for securing the cap to the body. We have found that when a capsule is band sealed one or more times with a sealant by either one or a combination of at least two of the following steps (A) to (E):

- the step (A) of applying the sealant at a temperature of 30 to 40° C. at least when the sealant is first applied,
- the step (B) of applying the sealant having a viscosity of 50 to 200 centipoises at 50° C. at least when the sealant is first applied,
- the step (C) of after the sealant is applied, blowing cold air at a temperature of lower than 10° C. to the band seal to cool the band seal below 10° C.,
- the step (D) of reducing the joint distance between the body and the cap shorter than the standard capsule length, and
- the step (E) of applying the sealant to only an edge adjacent portion of the cap surface when the sealant is first applied, it becomes possible to prevent bubbles and perforations from occurring in the band seal.

According to the invention, there is provided a method for forming a band seal as defined just above wherein the step of applying a gelatin-base sealant is carried out by either one or a combination of at least two of steps (A) to (E).

Note that the axial direction is the direction of an axis connecting the closed ends of the cap and the body.

DETAILED DESCRIPTION OF THE INVENTION

Figure 1:
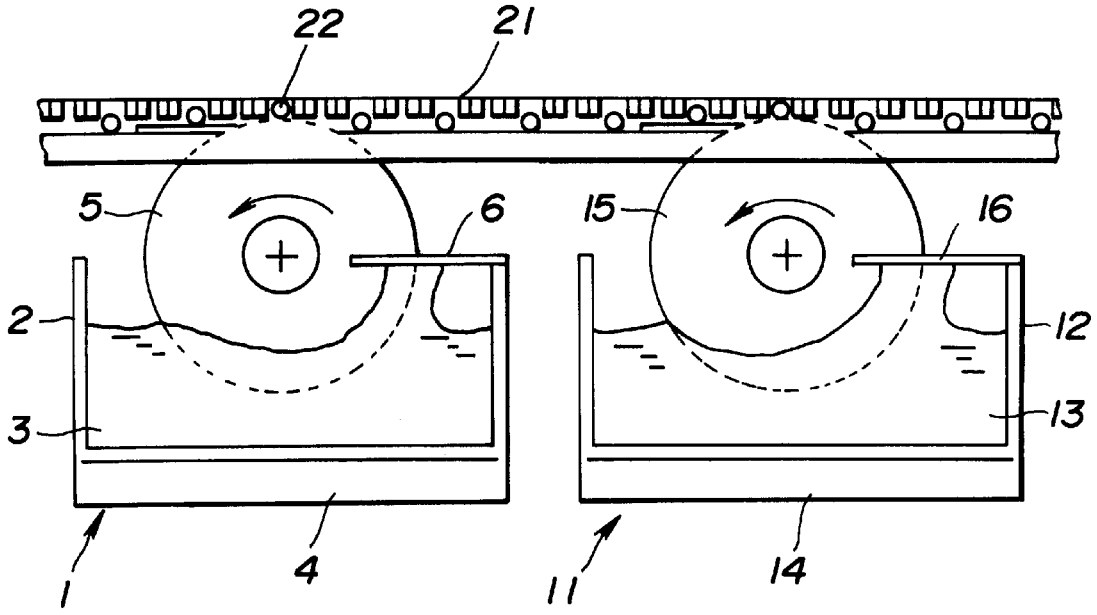
FIG. 1 is a schematic elevational view of an apparatus for forming a band seal on capsules.

The band seal forming method according to the invention is advantageously applied to gelatin capsules although the invention is not limited thereto. No particular limit is imposed on the size of the capsule and the type of the drug to be filled therein.

When a band seal is formed on a capsule, the invention employs at least one or a combination of at least two of the steps (A) to (E):

- the step (A) of applying the sealant at a temperature of at least 30 to 40° C. when the sealant is first applied,
- the step (B) of applying the sealant having a viscosity of 50 to 200 centipoises at least 50° C. when the sealant is first applied,
- the step (C) of after the sealant is applied, blowing cold air at a temperature of lower than 10° C. to the band seal to cool the band seal below 10° C.,
- the step (D) of reducing the joint distance between the body and the cap shorter than the standard capsule length, and
- the step (E) of applying the sealant to only an edge adjacent portion of the cap surface when the sealant is first applied.

A prior art method of forming a band seal on a capsule is by furnishing a sealant in the form of an aqueous gelatin solution having a viscosity of 300 to 400 centipoises at 50° C. and applying the sealant to a capsule at a temperature of 50 to 60° C. The sealant is applied one time or two or more times. The prior art band sealing method has the drawback that bubbles and perforations occur in the band seal as previously mentioned.

We have found the following: The reason why bubbles generate is that air in the capsule or air at the junction between the body and the cap expands when a sealant at elevated temperature is applied to the capsule around its entire circumference. When band sealing is repeated plural times, the influence of the temperature of the sealant is most significant when the sealant is applied for the first time. Based on this finding, we have succeeded in restraining the generation of bubbles in the band seal by the step (A) of carrying out at least the first application of the sealant in the form of an aqueous gelatin solution at a low temperature near the limit at which gelatin coagulates, typically 30 to 40° C., preferably 31 to 33° C. Where band sealing is carried out two or more times, insofar as a first shot of the sealant is applied at a low temperature, the temperature of second and later shots of the sealant to be applied is not particularly limited. Preferably second and later shots of the sealant are applied at a low temperature of 30 to 40° C., especially 30 to 32° C. In the practice of step (A), the first shot of the sealant should preferably have a viscosity of 50 to 200 centipoises at 50° C. according to step (B) to be described later. However, the first shot of the sealant may have a viscosity as used in the prior art. For example, a sealant having a viscosity of more than 200 centipoises at 50° C., especially 300 to 400 centipoises at 50° C. may be used as the first shot. Where band sealing is carried out two or more times, second and later shots of the sealant may have a viscosity of 50 to 400 centipoises at 50° C.

The second means (B) for effectively preventing bubbles from generating in the band seal is by using as a first shot of sealant an aqueous gelatin solution having a viscosity of 50 to 200 centipoises at 50° C., preferably 50 to 100 centipoises at 50° C. so that the first shot may provide a relatively small buildup of the sealant to reduce the amount of heat imparted to the capsule. Where band sealing is carried out two or more times, second and later shots of the sealant should preferably have a viscosity of 50 to 200 centipoises at 50° C., especially 50 to 100 centipoises at 50° C. In the practice of step (B), the first shot of the sealant upon application should preferably have a temperature of 30 to 40° C., especially 30 to 32° C. according to step (A). However, the first shot of the sealant may have a temperature as used in the prior art, for example, in the range of 30 to 60° C. Where band sealing is carried out two or more times, second and later shots of the sealant may have such a temperature.

The third means (C) for effectively preventing bubbles from generating in the band seal is by blowing cold air at a temperature of up to 10° C. to the band seal immediately after the sealant is applied, to thereby cool the band seal below 10° C. This means is to dissipate the amount of heat imparted to the capsule upon sealing with a cold air blow, thereby promoting gelation of gelatin to increase the strength of a seal film before generation of bubbles. Where band sealing is carried out plural times, cold air is effectively blown immediately after the first shot of sealant is applied, but may be blown after the last shot of sealant is applied. In the practice of step (C), the sealant upon band sealing may have a temperature and a viscosity as in the prior art although it is recommended to combine step (C) with step (A) and/or (B).

The fourth means (D) for mitigating defects in the band seal is by reducing the joint distance between the body and the cap shorter than the standard capsule length. More particularly, there are available capsules of various sizes including Nos. 0, 1, 2, 3, 4, and 5. According to the invention, the joint distance between the body and the cap is made shorter than the standard capsule size. The joint distance between the body and the cap is the distance between the open end of the cap and the open end of the body when the cap is fitted on the body. The conventional joint distance of capsules is 21.8 mm for No. 0 capsules, 19.4 to 19.5 mm for No. 1 capsules, 17.8 mm for No. 2 capsules, 15.8 to 15.9 mm for No. 3 capsules, 14.5 mm for No. 4 capsules, and 11.4 mm for No. 5 capsules. According to the invention, the joint distance is made shorter than the minimum joint length of the standard capsule. In the case of No. 2 capsules, for example, the joint distance is made shorter than 17.8 mm, typically the joint distance is about 17.5 to 17.6 mm. It is preferred that the joint distance be made shorter than the minimum joint length of the standard capsule by 0.1 to 0.5 mm, especially 0.2 to 0.5 mm. By reducing the capsule joint distance, the lock strength is increased and the leakage of air from within the capsule upon band sealing is prohibited, thereby preventing bubbles from generating in the band seal. In the practice of step (D), the remaining conditions of the band sealing method may be the same as in the prior art although it is preferred to combine step (D) with at least one of steps (A) to (C).

Where band sealing is carried out two or more times, the step (E) of applying the sealant to only an edge adjacent portion of the cap surface upon first application is effective. By applying the sealant to only an edge adjacent portion of the cap surface rather than applying the sealant to an area extending from an edge adjacent portion of the cap to the body surface, only the cap is shrunk to increase the lock strength of the cap to the body for thereby preventing the leakage of air from within the capsule upon application of subsequent shots of sealant. When the sealant is first applied to only the edge adjacent portion of the cap, the remaining conditions of the band sealing method may be the same as in the prior art although it is preferred that an aqueous gelatin solution having a viscosity of 50 to 200 centipoises at 50° C., especially 50 to 100 centipoises at 50° C. be used as the sealant and applied at a temperature of 30 to 40° C., especially 30 to 32° C. After application, cold air or compressed air below 10° C. may be blown to the sealant film. On second and later shots of the sealant, it is preferred that an aqueous gelatin solution having a viscosity of 50 to 200 centipoises at 50° C., especially 50 to 100 centipoises at 50° C. be used as the sealant and applied at a temperature of 30 to 40° C., especially 30 to 32° C. Step (E) may be combined with step (D).

The band seal forming method of the invention may be carried out in a conventional manner insofar as at least one of steps (A) to (E) is employed. For example, pigments such as titanium oxide and coloring matters such as Blue No. 1 and Red No. 3 may be added to the aqueous gelatin solution. The band seal forming method may be carried out by means of a well-known band sealing apparatus. The axial width of the band seal may be properly determined in accordance with the capsule size.

EXAMPLE

Examples of the invention are given below by way of illustration and not by way of limitation.

In the following Examples, the capsules used were gelatin capsules of No. 2 size. In order to demonstrate the bubble restraining effect, the body and the cap were engaged over a joint distance of 17.80 mm without filling contents so that bubbles were most likely to generate in the band seal. The sealant used for band sealing was an aqueous gelatin solution having a varying concentration or viscosity.

Figure 2:
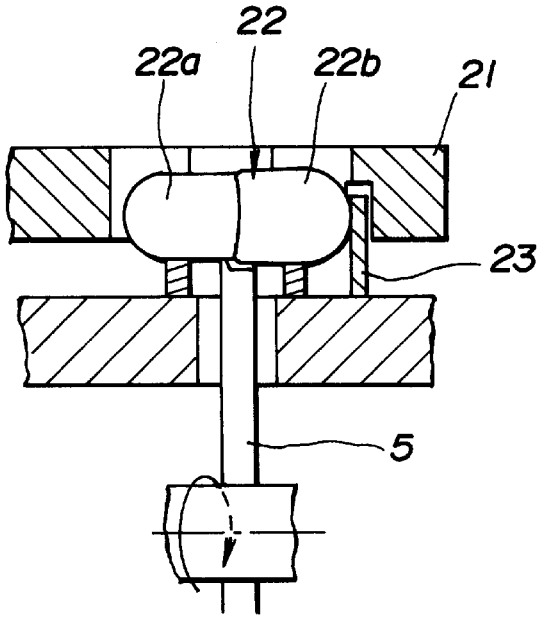
FIG. 2 is an enlarged transverse cross-sectional view of a portion of the apparatus where the sealant is applied to a capsule.

Band sealing was carried out by means of a fully automatic capsule sealing machine model S-100 (Japan Elanco Co., Ltd.) by applying the sealant two times. The sealing machine is schematically shown in FIGS. 1 and 2. The machine includes first and second sealing sections 1 and 11, tanks 2 and 12 containing sealants 3 and 13, respectively, heaters 4 and 14, sealing rollers 5 and 15, and scrapers 6 and 16. A slat conveyor 21 extends over the tanks 2 and 12 and moves from the first sealing section 1 to the second sealing section 11 (from the left to the right in FIG. 1). A capsule 22 consisting of a body 22*a* and a cap 22*b* is rotatably mounted in a set of slats. As the capsule 22 is moved forward by the slat conveyor 21, the sealing roller 5 of the first sealing section 1 applies the first sealant 3 to the capsule in a band pattern and the sealing roller 15 of the second sealing section 11 then applies the second sealant 13 to the capsule in a band pattern again. An alignment guide 23 is depicted in FIG. 2. Though not shown, after the second sealant 13 is applied in the second sealing section 11, the capsule 22 is transferred to a drying section where the sealant is dried. At the end of drying, the band seal is fused to the capsule. The band seal has an axial width of 2.0 mm for both the first and second seals. The first and second layers of band seal are formed such that the cap open end is located at the axial center of the band seal.

In the following Examples, whether or not bubbles were generated in the band seal was examined by a visual observation. A percent bubble generation is the number of bubble generated capsules per 100 capsules.

Example 1

Both the first and second sealants were an aqueous gelatin solution having a viscosity of 95 centipoises at 50° C. Band sealing was carried out as mentioned above while the first sealant was at a temperature as reported in Table 1 and the second sealant was at a temperature of 35° C. The results of bubble generation are shown in Table 1.

TABLE 1

| | Example 1 | | | |
|---|---|---|---|---|
| 1st sealant temperature (° C.) | 32 | 35 | 40 | 42 |
| Bubble generation (%) | 0 | 4 | 15.7 | 20 |

Example 2

Both the first and second sealants were an aqueous gelatin solution having a viscosity at 50° C. as reported in Table 2. Band sealing was carried out as mentioned above while the first and second sealants were at a temperature of 40° C. The buildups of the first and second seals and the results of bubble generation are shown in Table 2.

TABLE 2

| | Example 2 | | | |
|---|---|---|---|---|
| 1st & 2nd sealant viscosity (cps) | 50 | 125 | 200 | 220 |
| Buildup (mg) | 2.5 | 3.0 | 3.5 | 4.0 |
| Bubble generation (%) | 0 | 0 | 0 | 10 |

Example 3

Both the first and second sealants were an aqueous gelatin solution having a viscosity at 50° C. as reported in Table 3. Band sealing was carried out as mentioned above while the first and second sealants were at a temperature as reported in Table 3. The results of bubble generation are shown in Table 3.

TABLE 3

| | Example 3 | | | | Comparison |
|---|---|---|---|---|---|
| 1st & 2nd sealant viscosity (cps) | 600 | 430 | 220 | 100 | 280 |
| 1st & 2nd sealant temperature (° C.) | 35 | 35 | 40 | 45 | 45 |
| Bubble generation (%) | 20 | 0 | 11 | 0 | 80 |

Example 4

Both the first and second sealants were an aqueous gelatin solution having a viscosity of 95 centipoises at 50° C. The first sealant was at a temperature as reported in Table 4 and the second sealant was at a temperature of 35° C. Band sealing was carried out as mentioned above except that cold air at 10° C. was blown to the band seal immediately after application of the first sealant. The results of bubble generation are shown in Table 4.

TABLE 4

| | Example 4 | | | | |
|---|---|---|---|---|---|
| 1st sealant temperature (° C.) | 35 | 35 | 40 | 40 | 45 |
| Cold air blow | yes | no | yes | no | yes |
| Bubble generation (%) | 0 | 0 | 0 | 4.7 | 5.3 |

Example 5

Both the first and second sealants were an aqueous gelatin solution having a viscosity of 340 centipoises at 50° C. The first sealant was at a temperature as reported in Table 5 and the second sealant was at a temperature of 35° C. Band sealing was carried out as mentioned above except that the size (length) of the cap was changed to give a cap-body junction distance as reported in Table 5. The results of bubble generation are shown in Table 5.

TABLE 5

| | Example 5 | | | Comparison |
|---|---|---|---|---|
| Junction distance (mm) | 17.45 | 17.80 | 17.30 | 17.90 |
| 1st sealant temperature (° C.) | 35 | 35 | 50 | 50 |
| Bubble generation (%) | 0 | 0 | 18.6 | 100 |

Example 6

Both the first and second sealants were an aqueous gelatin solution having a viscosity of 95 centipoises at 50° C. The first sealant was at a temperature of 40° C. and the second sealant was at a temperature of 35° C. Band sealing was carried out as mentioned above except that the first sealant was applied to only an edge adjacent portion of the cap and the second sealant was then applied so as to extend from the edge adjacent portion of the cap to the body. The bubble generation is shown in Table 6.

For comparison purposes, band sealing was carried out as above except that the first sealant was applied so as to extend from the edge adjacent portion of the cap to the body. The result is also shown in Table 6.

TABLE 6

| | Example 6 | Comparison |
|---|---|---|
| Bubble generation (%) | 0 | 15.7 |

It has been demonstrated that the method of the invention can form a band seal on a capsule while positively restraining the generation of bubbles and voids during band sealing.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for forming a band seal between a body and a cap of a capsule, comprising the steps of:

fitting the cap on the body, and applying a gelatin-base sealant at least one time in the form of a band spanning the cap surface and the body surface across the edge of the cap to form at least one layer of band seal for securing the cap to the body, wherein the first application of the gelatin-base sealant is applied at a temperature of 30 to 40° C.

2. The method of claim 1, wherein the band sealing is carried out two or more times and each shot of the sealant is carried out by applying the sealant having a viscosity of 50 to 200 centipoises at 50° C. at a temperature of 30 to 40° C.

3. The method of claim 1 or 2, wherein air at a temperature of up to 10° C. is blown onto the band seal to cool the band seal below 10° C. after the sealant is applied.

4. The method of claim 1, wherein the joint distance between the body and the cap is less than 21.8 mm for No. 0 capsules, 19.4 mm for No. 1 capsules, 17.8 mm for No. 2 capsules, 15.8 mm for No. 3 capsules, 14.5 mm for No. 4 capsules, and 11.5 mm for No. 5 capsules.

5. A method for forming a band seal between a body and a cap of a capsule, comprising the steps of:

fitting the cap on the body, and applying a gelatin-base sealant at least one time in the form of a band spanning the cap surface and the body surface across the edge of the cap to form at least one layer of band seal for securing the cap to the body, wherein the first application of the gelatin-base sealant has a viscosity of 50 to 200 centipoises at 50° C.

6. The method of claim 5, wherein the sealant is applied at a temperature of 30 to 40° C.

7. The method of claim 5 or 6, wherein air at a temperature of up to 10° C. is blown at onto the band seal to cool the band seal below 10° C. after the sealant is applied.

8. The method of claim 5, wherein the joint distance between the body and the cap is less than 21.8 mm for No. 0 capsules, 19.4 mm for No. 1 capsules, 17.8 mm for No. 2 capsules, 15.8 mm for No. 3 capsules, 14.5 mm for No. 4 capsules, and 11.5 mm for No. 5 capsules.

9. A method for forming a band seal between a body and a cap of a capsule, comprising the steps of:

fitting the cap on the body, and applying a gelatin-base sealant at least one time in the form of a band spanning the cap surface and the body surface across the edge of the cap to form at least one layer of band seal for securing the cap to the body, wherein the first application of the gelatin-base sealant is applied to only an edge adjacent portion of the cap surface to shrink the cap, then the cap is fitted on the body, and then a second gelatin-base sealant is applied at least one time in the form of a band spanning the cap surface and the body surface across the edge of the cap to form at least one layer of band seal for securing the cap to the body, wherein the second sealant is applied at a temperature of 30 to 40° C.

10. The method of claim 9, wherein the second sealant has a viscosity of 50 to 200 centipoises at 50° C.

11. The method of claim 9, wherein air at a temperature of up to 10° C. is blown to the band seal to cool the band seal below 10° C. after the second sealant is applied.

12. The method of claim 9, wherein the joint distance between the body and the cap is less than 21.8 mm for No. 0 capsules, 19.4 mm for No. 1 capsules, 17.8 mm for No. 2 capsules, 15.8 mm for No. 3 capsules, 14.5 mm for No. 4 capsules, and 11.5 mm for No. 5 capsules.

13. A method for forming a band seal between a body and a cap of a capsule, comprising the steps of:

fitting the cap on the body, and applying a gelatin-base sealant at least one time in the form of a band spanning the cap surface and the body surface across the edge of the cap to form a least one layer of band seal for securing the cap to the body, wherein the joint distance between the body and the cap is less than 21.8 mm for No. 0 capsules, 19.4 mm for No. 1 capsules, 17.8 mm for No. 2 capsules, 15.8 mm for No. 3 capsules, 14.5 mm for No. 4 capsules, and 11.5 mm for No. 5 capsules.

* * * * *